US008220897B2

(12) United States Patent
Robinson et al.

(10) Patent No.: US 8,220,897 B2
(45) Date of Patent: Jul. 17, 2012

(54) COMPUTER BASED METHOD AND SYSTEM FOR ADJUSTING PAGE PLACEMENT ON A CONTINUOUS FEED PRINT ENGINE

(75) Inventors: David C. Robinson, Penfield, NY (US); Frederick John Ramsey, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 371 days.

(21) Appl. No.: 12/646,458

(22) Filed: Dec. 23, 2009

(65) Prior Publication Data

US 2011/0148974 A1 Jun. 23, 2011

(51) Int. Cl.
*B41J 29/393* (2006.01)

(52) U.S. Cl. ..... 347/19

(58) Field of Classification Search ..... 347/19, 347/101, 104–106
See application file for complete search history.

(56) References Cited

U.S. PATENT DOCUMENTS 6,786,149 B1 9/2004 Lomoine et al.
7,865,125 B2 * 1/2011 Moore ..... 399/384

OTHER PUBLICATIONS

U.S. Appl. No. 12/560,483, filed Sep. 16, 2009, McLaughlin (unpublished application).

* cited by examiner

*Primary Examiner* — An Do
(74) *Attorney, Agent, or Firm* — Simpson & Simpson, PLLC

(57) ABSTRACT

A system for adjusting page placement on a continuous feed print engine. The engine includes: a feed system for displacing a continuous sheet of material in a process direction; and at least one printhead with a plurality of ink ejectors. The system includes at least one specially programmed computer with a processor and memory element. The processor receives ejector data regarding a defective ink ejector. The ejector data includes a position for the ejector in a transverse direction. The memory element stores the ejector data. The processor: receives print data including positions, in the transverse direction, for pixels on the page; creates, using the processor and the print data, a logical page; and creates, using the processor and the ejector data, a logical sheet by positioning the logical page in the traverse direction such that the ejector and the respective pixels are out of alignment in the process direction.

18 Claims, 3 Drawing Sheets

COMPUTER BASED METHOD AND SYSTEM FOR ADJUSTING PAGE PLACEMENT ON A CONTINUOUS FEED PRINT ENGINE

TECHNICAL FIELD

The present disclosure relates to a continuous feed print engine and image placement to avoid a defective ink ejector. In particular, the present disclosure relates to disposing or shifting a position of a logical page in a logical sheet.

BACKGROUND

FIG. 4 illustrates a continuous feed print engine as shown in co-pending U.S. patent application Ser. No. 12/560,483, filed Sep. 16, 2009, the disclosure of which is incorporated herein by reference in its entirety. A continuous feed print engine prints respective pages on a single, continuous sheet of media feed through the print engine. For example, in FIG. 4, a roll of material on which images are to be printed, for example, a roll of paper, is placed in the supply device. The unwinder feeds the roll of paper in a continuous stream through the printer in process direction P. The printer prints pages on the sheet and individual pages are cut from the sheet by the cutter. Instructions and data regarding control of the unwinder and the printing process are provided by the computer. Some continuous feed print engines, such as the engine in FIG. 4, are configured to print images onto both sides of the media, also referred to as duplex printing.

In FIG. 4, a web supply and transport system is configured to supply a very long (i.e., substantially continuous) web W of media (paper, plastic, or other printable material) from an unwinder 10. The web W may be unwound as needed, and propelled by a variety of motors, not shown, along a web path. A set of rollers 12 controls the tension of the web as the web moves through the path.

The imaging device of FIG. 4 is a duplex printer meaning that it is capable of printing images onto both sides of the continuous web. In an example embodiment, to enable duplex printing, the web transport system (and printing system) is a dual width, or dual path, transport system that is configured to transport two lengths of the web along the web path simultaneously. In an example embodiment, the rollers that transport and guide the web along the web path are at least twice the width of the web to accommodate the two lengths of the web. A first side of the web transport system is configured to transport a portion of the web W with one of the surfaces of the web facing in a direction to be printed upon by the printheads of the print station, also referred to herein as the printing, or process, direction. The second side of the web transport system is configured to transport a portion of the web with the opposite surface, i.e., the duplex surface, of the web facing the printing direction. The first or simplex side and the second or duplex side of the web transport system may also be referred to as the first or simplex web path and the second or duplex web path, respectively. The dual web path of the web transport system includes entrance roller(s) and an exit roller(s) 28.

The web transport system is configured to transport the web along the simplex and duplex web paths simultaneously and maintain consistent lateral positioning of the webs at least in the print zone so that images formed on the web are accurately registered. Any suitable method of registering or positioning of the webs along the dual path web transport system may be utilized. For example, edge sensors, as are known in the art, may be used to detect the edges of the webs, and suitable mechanisms for correcting or compensating for deviations of the web positions from desired positions may be used to adjust the lateral positions of the web at one or more positions along the dual web paths to ensure consistent and accurate positioning and/or spacing of the webs at least in the print zone. Also shown are printheads 22, midheaters 30, "spreader" 40, and rolls 42 and 44, and station 48.

In general, ink jet printing machines or printers include at least one printhead that ejects drops or jets of colorant, such as liquid ink, onto a recording or image forming media. A printhead includes a plurality of ink ejectors through which colorant is ejected onto the sheet. The ejectors can become clogged or otherwise fail to eject sufficient colorant. In this case, the volume of colorant ejected from adjacent or downstream ejectors can be increased in an attempt to compensate for the defective ejectors. However, the quality of the image on the portion of the sheet associated with the defective ejectors is inferior to the quality that properly operating ejectors would produce.

SUMMARY

According to aspects illustrated herein, there is provided a computer based method for adjusting page placement on a continuous feed print engine. The continuous feed print engine includes: a feed system for displacing a continuous sheet of material in a process direction; and at least one printhead with a plurality of ink ejectors. The method includes: receiving from the print engine, using a processor for at least one specially programmed computer, ejector data regarding a defective ink ejector, from the plurality of ink ejectors, the ejector data including a position for the ejector with respect to a transverse direction orthogonal to the process direction; storing the ejector data in a first memory element for the at least one specially programmed computer; receiving, using the processor, print data regarding a page to be printed on the continuous sheet, the print data including positions, with respect to the transverse direction, for respective pixels on the page; creating, using the processor and the print data, an imposed logical page for the page; and creating, using the processor, the logical page, and the ejector data, a logical sheet by positioning the logical page, in the transverse direction, within the logical sheet such that the ink ejector and the positions for the respective pixels on the page are out of alignment in the process direction.

According to aspects illustrated herein, there is provided a computer based method for adjusting page placement on a continuous feed duplex print engine, wherein the continuous feed duplex print engine includes a feed system for displacing first and second sides of a continuous sheet of material in a process direction; and at least one printhead with a plurality of ink ejectors. The method includes: receiving from the print engine, using a processor for at least one specially programmed computer, ejector data regarding first and second defective ink ejectors from the plurality of ink ejectors, the ejector data including respective positions for the first and second defective ink ejectors with respect to a transverse direction orthogonal to the process direction; storing the ejector data in a memory element for the at least one specially programmed computer; receiving, using the processor, print data regarding first and second pages to be printed on the first and second sides, respectively, of the continuous sheet, the print data including positions, with respect to the transverse direction, for respective pixels on the first and second pages; creating, using the processor and the print data, first and second logical pages for the first and second pages, respectively; and creating, using the processor, the first and second logical pages, and the ejector data, first and second logical sheets by positioning, in the transverse direction, the first and second logical pages within the first and second logical sheets, respectively, such that the first and second defective ink ejectors and the positions for the respective pixels on the first and second pages, respectively, are out of alignment in the process direction.

According to aspects illustrated herein, there is provided a computer based method for adjusting page placement on a continuous feed print engine with at least one printhead having a plurality of ink ejectors, including storing, in a memory element for at least one specially programmed computer, a logical sheet including a position, with respect to a transverse direction orthogonal to the process direction, for a logical page for a page to be printed on a continuous sheet by the print engine, the logical page including positions, with respect to the transverse direction, for respective pixels on the page; receiving from the print engine, using a processor for the at least one specially programmed computer, ejector data including a position, with respect to the transverse direction, for an ink ejector, from the plurality of ink ejectors, operating in an undesirable manner; determining, using the processor and the ejector data, that the position for the ink ejector and the position for the page are in alignment in the process direction; and shifting in the transverse direction, using the processor, the logical page within the logical sheet to position the page on the continuous sheet such that the ink ejector and the positions for respective the on the page are out of alignment in the process direction.

According to aspects illustrated herein, there is provided a system for adjusting page placement on a continuous feed print engine, including: a continuous feed print engine including a feed system for displacing a continuous sheet of material in a process direction and at least one printhead with a plurality of ink ejectors; and at least one specially programmed computer with a processor and a memory element. The processor is for receiving, from the print engine, ejector data regarding a defective ink ejector, from the plurality of ink ejectors, the ejector data including a position for the ejector with respect to a transverse direction orthogonal to the process direction. The memory element is for storing the ejector data. The processor is for: receiving print data regarding a page to be printed on the continuous sheet, the print data including positions, with respect to the transverse direction, for respective pixels on the page; creating, using the processor and the print data, a logical page for the page; and creating, using the processor and the ejector data, a logical sheet including the logical page by positioning the logical page, in the transverse direction, within the logical sheet such that the ink ejector and the positions for the respective pixels on the page are out of alignment in the process direction.

According to aspects illustrated herein, there is provided a system for adjusting page placement on a continuous feed duplex print engine, including: a continuous feed print engine including: a feed system for displacing first and second sides of a continuous sheet of material in a process direction; and at least one printhead with a plurality of ink ejectors. The system also includes at least one specially programmed computer with a processor and a memory element. The processor is for receiving, from the print engine, ejector data regarding first and second defective ink ejectors, from the plurality of ink ejectors, the ejector data including respective positions for the first and second defective ink ejectors with respect to a transverse direction orthogonal to the process direction. The memory element is for storing the ejector data. The processor is for: receiving print data regarding first and second pages to be printed on the first and second sides, respectively, of the continuous sheet, the print data including positions, with respect to the transverse direction, for respective pixels on the first and second pages; creating, using the processor and the ejector data, first and second logical sheets including the first and second logical pages, respectively, by positioning the first and second logical pages, in the transverse direction, such that the first and second defective ink ejectors and the positions for the respective pixels on the first and second pages, respectively, are out of alignment in the process direction.

According to aspects illustrated herein, there is provided a system for adjusting page placement on a continuous feed print engine, including a continuous feed print engine including at least one printhead with a plurality of ink ejectors; and at least one specially programmed computer with a processor and a memory element. The memory element is for storing a logical sheet including a position, with respect to a transverse direction orthogonal to the process direction, for a logical page for a page to be printed on a continuous sheet by the print engine, the logical page including positions, with respect to the transverse direction, for respective pixels on the page. The processor is for: receiving from the print engine, ejector data including a position, with respect to the transverse direction, for an ink ejector, from the plurality of ink ejectors, operating in an undesirable manner; determining, using the ejector data, that the position for the ink ejector and the position for the page are in alignment in the process direction; and shifting the logical page to position the page on the continuous sheet such that the ink ejector and the positions for the respective pixels on the page are out of alignment in the process direction.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
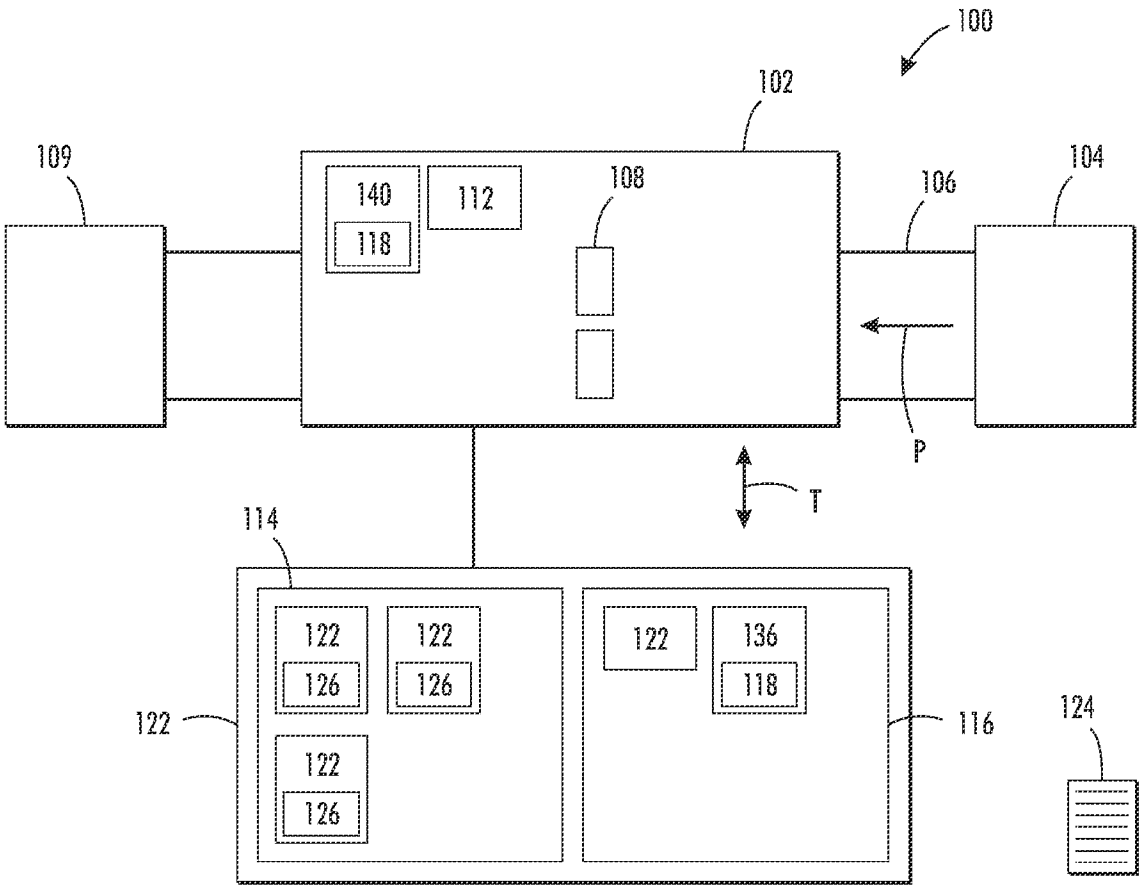
FIG. 1 is a block diagram of a system for adjusting image placement on a continuous feed print engine.

FIG. 1 is a block diagram of system 100 for adjusting image placement on continuous feed print engine 102. The system includes sheet supply device 104 for displacing continuous sheet of material 106 in process direction P, and at least one printhead 108. Engine 102 is not limited to a particular number of printheads. The printed sheet is folded, cut, or otherwise operated upon by finishing device 109.

Figure 2:
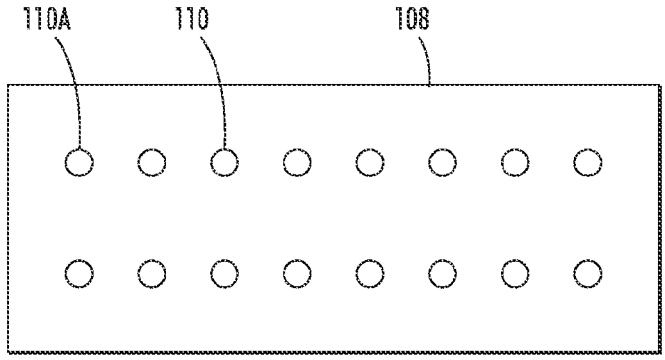
FIG. 2 is a schematic representation of the printhead shown in FIG. 1, showing exemplary ejectors.

FIG. 2 is a schematic representation of printhead 108 shown in FIG. 1, showing exemplary emission points for ink ejectors 110. By "ink ejector" we mean a device with an ejector, for example, nozzle, which in response to an applied digital signal, emits, for example, ejects, a droplet of colorant to a desired small area of the sheet to form a pixel or a portion of a pixel. That is, the ejector provides a "drop on demand." Printhead 108 includes a plurality of ink ejectors 110. To simplify presentation, only a limited number of ejectors are shown. However, it should be understood that printhead 108 is not limited to a particular number of ejectors.

The following should be viewed in light of FIGS. 1 and 2. System 100 also includes at least one specially programmed computer 112 with processor 114 and memory element 116. The processor is for receiving, from the print engine, ejector data 118 regarding one of ink ejectors 110, for example, ejector 110A, operating in an undesirable manner. The defect in the ejector can be detected by any means known in the art. In an example embodiment, operating in an undesirable manner includes generating a colorant density on the sheet less than a predetermined colorant density. In an example embodiment, operating in an undesirable manner includes the ejector clogging. The ejector data also includes position 120 for the ejector with respect to transverse direction T orthogonal to the process direction. The memory element is for storing the ejector data. The processor also receives print data 122 regarding page 124 to be printed on the continuous sheet. The print data includes positions 126, with respect to the transverse direction, for respective pixels on the page. That is, positions 126 identify where portions of an image or images for page 124 are to be printed on the page in the T direction.

The processor creates, using the print data, an imposed logical page 130 for each page to be printed on a continuous sheet, for example, on sheet 106, as the sheet is displaced through engine 102 by feed mechanism 104. By "logical page" we mean a two dimensional electronically mapped collection of data objects which in total constitute the total contents of a page of data, for example, data for an image to be printed on the sheet for page 124. Thus, a logical page is digital data generated by the processor for the layout and printing of a respective page 124. For example, the logical page includes instructions for what the print engine is to print and where the print engine is to print on the sheet.

Figure 3:
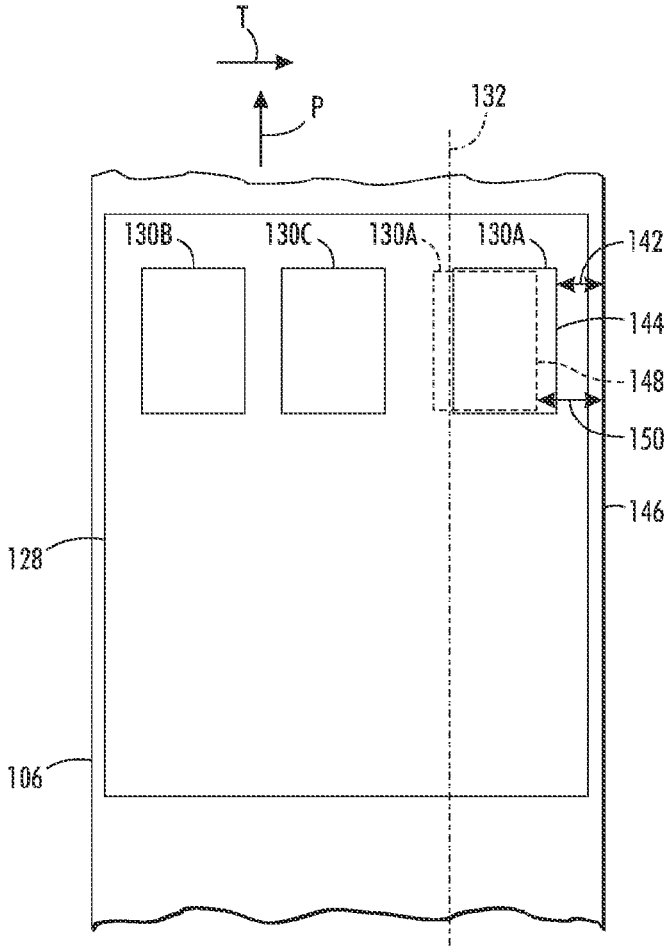
FIG. 3 is a schematic representation of a logical sheet shown with respect to a sheet; and, FIG. 4 illustrates a continuous feed duplex print engine.

FIG. 3 is a schematic representation of logical sheet 128 shown with respect to the continuous web. The following should be viewed in light of FIGS. 1 through 3. The processor creates logical sheet 128 using the ejector data and logical pages 130. By "logical sheet" we mean an electronic representation of the positions of respective logical pages with respect to the continuous sheet. For example, the logical sheet includes positions for respective pages 124 in the P and T directions. Logical page 130 is positioned, in direction T, within the logical sheet such that ink ejector 110A and the positions for respective pixels on the page are out of alignment in the process direction. That is, processor shifts the logical page in the T direction such that the respective pixels avoid overlapping the defective ejector in the process direction. By "pixel," we mean an area of the sheet upon which colorant has been placed by an ejector, for example, as some or all of an image, text, symbols, graphs, charts, or pictures. In an example embodiment, buffered logical pages in bit mapped format are placed in appropriate position on a logical sheet. The logical sheet is then downloaded to the printer to form an actual sheet.

In FIG. 3 an example alignment of ejector 110A in the process direction is shown by line 132. In one example shown in FIG. 3, the processor would determine, in the absence of ejector data 118, the positions for logical pages 130A-C such that the logical pages would be evenly spaced in the T direction, for example, to facilitate operations in the finished device. Such a position for logical page 130A is shown by dashed lines. However, the processor notes that line 132 is in alignment in the P direction with the dashed line location. Therefore, the processor determines the position for logical page 130A (shown in solid lines) such that the defective ink ejector and the page are out of alignment in the process direction. That is, processor shifts the logical page in the T direction such that the logical page avoids overlapping the defective ejector in the process direction. In this manner, ink ejector 110A and the positions for the respective portions of the image for 130A are out of alignment in the process direction, since the ejector does not overlap the page anywhere in the process direction.

In an example embodiment, logical sheet 136 with logical pages 138 is already stored in the memory element when data, such as ejector data 118, is received by the processor regarding a defective ejector 110. In a manner similar to that described supra, the processor shifts the positions of logical pages 138 such that the ink ejector and the positions for the respective portions of the image for the page are out of alignment in the process direction. For example, as described supra, the processor can shift logical pages 138 such that the logical pages do not overlap a defective ejector in the process direction.

In an example embodiment, the print engine includes a memory element 140 for storing the ejector data. That is, the print engine detects the defective ejector and stores ejector data 118 in element 140. The print engine transfers the ejector data from memory element 140 to memory element 116. In an example embodiment, the print engine includes the at least one specially programmed computer 112.

In an example embodiment, the print data includes a first position for the page with respect to the traverse direction and the printed logical page is in a second position, different than the first position, with respect to the traverse direction. That is, the repositioning of a logical page to avoid an undesirable ejector can be detected by the change of the position of a printed page in direction T. In an example embodiment, the change in position is quantified with respect to respective edges of a page, a logical page, and the material. For example, the print data includes distance 142 from edge 144 of the page to edge 146 of the material. Corresponding edge 148 of the printed logical page is located distance 150, different than distance 142, from the edge of the material. It should be understood that other measurements can be used to quantify the repositioning of a logical page.

In an example embodiment, the print engine is a continuous feed duplex print engine, for example as described supra, configured to print images onto both sides of material 106, and the discussion for FIGS. 1-3 is applicable to operations with respect to both sides of material 106. For example, the respective discussions regarding: ejector data 118; print data 122; logical sheet 128; imposed logical pages 130; logical sheet 136 with logical pages 138; and memory element 140. For example, for a clogged injector, a logical page for the second side (duplex printing) of material 106 is positioned, with respect to the T direction, in a logical sheet to avoid the clogged injector.

Figure 4:
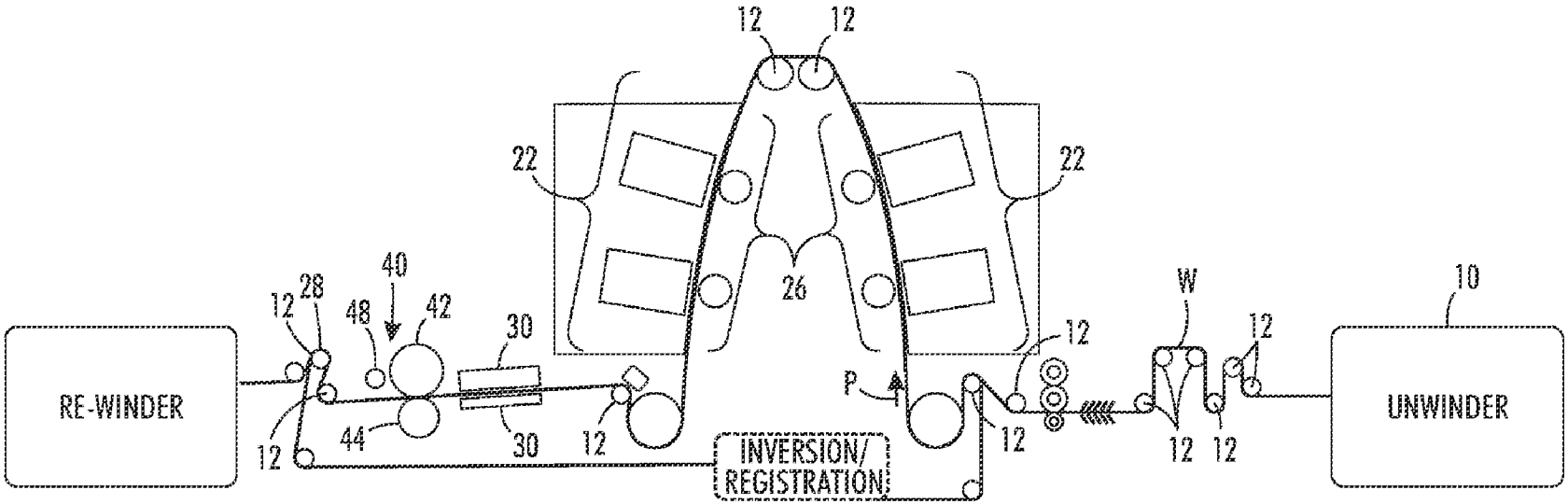

In an example embodiment, the continuous feed duplex print engine includes a feed system, for example, as shown in FIG. 4, for displacing first and second sides of a continuous sheet of material, for example, material 106, in process direction P. In an example embodiment, the first and second sides are side-by-side in the T direction and are simultaneously displaced through the engine. The engine includes at least one printhead with a plurality of ink ejectors, for example, printhead 108, and at least one specially programmed computer with a processor and a memory element, for example, computer 112 and memory 116. The processor is for receiving, from the print engine, ejector data regarding first and second defective ink ejectors from the plurality of ink ejectors. The first and second defective ink injectors are in the process path for the first and second sides of the material, respectively. The ejector data includes respective positions for the first and second defective ink ejectors with respect to direction T. The memory element stores the ejector data, and the processor is for receiving print data regarding first and second pages to be printed on the first and second sides, respectively, of the continuous sheet. The print data includes positions, with respect to the T direction, for respective pixels on the first and second pages. The print data also includes a registration between respective pages on the two sides of material 106, for example between the first and second pages. The processor creates, using the print data, the first and second logical pages for the first and second pages. The processor also creates, using the ejector data, first and second logical sheets including the first and second logical pages, respectively, by positioning, in the T direction, the first and second logical pages such that the first and second defective ink ejectors and the positions for the respective pixels on the first and second pages, respectively, are out of alignment in the process direction. The processor also maintains the registration between the two sides of the sheet, for example, between the first and second pages.

The discussion above regarding positions with respect to the traverse direction for the logical page and the printed logical page is applicable to the continuous feed duplex print engine described supra. The discussion above regarding distances 142 and 150, and edges 144, 146, and 148 is applicable to the continuous feed duplex print engine described supra.

In an example embodiment, in response to receiving a signal indicating that the improperly working injector or injectors are working properly, the processor determines the feasibility and possible advantage of re-positioning shifted logical pages to conform to respective positions included in the print data, or of generating positions for logical pages without shifting to avoid the position of the formerly improperly working injector or injectors. If the processor determines that the re-positioning or position generating is feasible and advantageous, the processor implements such re-positioning or position generating.

In an example embodiment, a logical page includes one or more of the following commands:

1 Up: The 1 Up Layout Style centers the page on the output sheet. Unlike the None layout style, the system can access and adjust the advanced settings with this layout style.

2 Up: The 2 Up Layout Style places two pages on a single sheet. The system can impose page 1 and 2 on one sheet of paper by selecting the Sequential option under Pages on Sheet Side, or the system can impose two of the same pages on one sheet of paper by selecting the Repeated option. The output can be single-sided or double-sided.

Selecting the Alternating option imposes an odd page on the front and an even page on the back; for example two pages 1 on the front and two pages 2 on the back.

2 Up Flip Right: The 2 Up—Flip Right Layout Style is used for jobs to be bound on both ends of the output document and then cut down the middle. This model allows the cut edge to be the same on both finished booklets after binding and cutting. The output can be single-sided or two-sided. To illustrate how a 2 Up—Flip Right job is imposed, consider an 8-page, 8.5 inch×11 inch job. The system can output to ledger and create two 8-page booklets that are identical, or the system can output to letter and create two 5.5 inch×8.5 inch booklets that are identical. If duplex is selected, page 1 is printed twice on side 1 of the first sheet, with the second page 1 rotated 180 degrees relative to the first. Then, page 2 would be printed in the same manner on side 2 of the first sheet, and so on. Then, each end of the page could be bound offline, and cut down the middle. If the system is printing images that go right to the edge along which the cut takes place, the system may need to adjust bleed and trim settings in the Advanced Settings dialog.

2 Up Cut & Stack: The 2 Up—Cut & Stack Layout Style is used to create a document which can be cut down the center and combined to form one job. The output can be single-sided or two-sided. To illustrate how a 2 Up—Cut & Stack job is imposed, consider an 8-page, 8.5 inch×11 inch job. If the output is Ledger-sized paper (11 inch×17 inch), there will be 4 original pages printing on two Ledger sheets. Page 1 is on the right-front of output sheet 1, and page 2 is directly behind it on the back of sheet 1. Page 3 is on the right-front of output sheet 2, and page 4 is directly behind it on the back of sheet 2. Page 5 is inverted (rotated 180 degrees) on the left front of sheet 1, and page 6 is directly behind page 5 on sheet 1, image inverted. Page 7 prints inverted, on the left front of sheet 2, and page 8 is directly behind it, also inverted. The images imposed on the left side of the output sheets are inverted to provide uniform margins and a uniform cut so that when they are bound, everything is in proper alignment. After cutting, and prior to Perfect binding, the pages from the left side of the output sheets are rotated 180 degrees and placed under the pages from the right side of the output sheets. The same imposition arrangements hold true if the output is on 8.5 inch×11 inch sheets, except that the pages are scaled to half size. No white space is left between pages.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What we claim is:

1. A computer based method for adjusting page placement on a continuous feed print engine, wherein the continuous feed print engine includes:

a feed system for displacing a continuous sheet of material in a process direction; and, at least one printhead with a plurality of ink ejectors, the method comprising:

receiving from the print engine, using a processor for at least one specially programmed computer, ejector data regarding a defective ink ejector, from the plurality of ink ejectors, the ejector data including a position for the ejector with respect to a transverse direction orthogonal to the process direction;

storing the ejector data in a first memory element for the at least one specially programmed computer;

receiving, using the processor, print data regarding a page to be printed on the continuous sheet, the print data including positions, with respect to the transverse direction, for respective pixels on the page;

creating, using the processor and the print data, a logical page for the page; and, creating, using the processor, the logical page, and the ejector data, a logical sheet by positioning the logical page, in the transverse direction, within the logical sheet such that the ink ejector and the positions for the respective pixels on the page are out of alignment in the process direction.

2. The computer based method of claim 1 wherein the print engine includes a second memory element, and the method includes:

storing the ejector data in the second memory element; and, transferring the ejector data from the second memory element to the first memory element.

3. The computer based method of claim 1 wherein the print engine includes the at least one specially programmed computer.

4. The computer based method of claim 1 wherein the ink ejector and the positions for the respective pixels on the page being out of alignment in the process direction includes the ink ejector and the page being out of alignment in the process direction.

5. The computer based method of claim 1 further comprising printing the logical page in a first position with respect to the traverse direction, wherein the print data includes a second position for the page with respect to the traverse direction, different from the first position.

6. A computer based method for adjusting page placement on a continuous feed print engine with at least one printhead having a plurality of ink ejectors, comprising:

storing, in a memory element for at least one specially programmed computer, a logical sheet including a position, with respect to a transverse direction orthogonal to the process direction, for a logical page for a page to be printed on a continuous sheet by the print engine, the logical page including positions, with respect to the transverse direction, for respective pixels on the page;

receiving from the print engine, using a processor for the at least one specially programmed computer, ejector data including a position, with respect to the transverse direction, for an ink ejector, from the plurality of ink ejectors, operating in an undesirable manner;

determining, using the processor and the ejector data, that the position for the ink ejector and the position for the page are in alignment in the process direction; and, shifting in the transverse direction, using the processor, the logical page within the logical sheet to position the page on the continuous sheet such that the ink ejector and the positions for the respective pixels on the page are out of alignment in the process direction.

7. The computer based method of claim 6 wherein the print engine includes a second memory element, and the method includes:

storing the ejector data in the second memory element; and, transferring the ejector data from the second memory element to the first memory element.

8. The computer based method of claim 6 wherein the print engine includes the at least one specially programmed computer.

9. The computer based method of claim 6 further comprising printing the logical page in a first position with respect to the traverse direction, wherein the logical sheet includes a second position for the page with respect to the traverse direction, different than the first position.

10. A system for adjusting page placement on a continuous feed print engine, comprising:

a continuous feed print engine including:

a feed system for displacing a continuous sheet of material in a process direction; and, at least one printhead with a plurality of ink ejectors; and, at least one specially programmed computer with a processor and a first memory element, wherein:

the processor is for receiving, from the print engine, ejector data regarding a defective ink ejector, from the plurality of ink ejectors, the ejector data including a position for the ejector with respect to a transverse direction orthogonal to the process direction;

the first memory element is for storing the ejector data;

the processor is for:

receiving print data regarding a page to be printed on the continuous sheet, the print data including positions, with respect to the transverse direction, for respective pixels on the page;

creating, using the processor and the print data, a logical page for the page; and, creating, using the processor and the ejector data, a logical sheet including the logical page by positioning the logical page, in the transverse direction, within the logical sheet such that the ink ejector and the positions for the respective pixels on the page are out of alignment in the process direction.

11. The system of claim 10 wherein:

the print engine includes a second memory element for storing the ejector data in the second memory element; and, the print engine is for transferring the ejector data from the second memory element to the first memory element.

12. The system of claim 10 wherein the print engine includes the at least one specially programmed computer.

13. The system of claim 10 wherein the ink ejector and the positions for the respective pixels on the page being out of alignment in the process direction includes the ink ejector and the page being out of alignment in the process direction.

14. The system of claim 10 wherein:

the logical page is in a first position with respect to the traverse direction: and, the print data includes a second position for the page with respect to the traverse direction, different than the first position.

15. A system for adjusting page placement on a continuous feed print engine, comprising:

a continuous feed print engine including at least one printhead with a plurality of ink ejectors; and, at least one specially programmed computer with a processor and a first memory element, wherein:

the first memory element is for storing a logical sheet including a position, with respect to a transverse direction orthogonal to the process direction, for a logical page for a page to be printed on a continuous sheet by the print engine, the logical page including positions, with respect to the transverse direction, for respective pixels on the page; and, the processor is for:

receiving from the print engine, ejector data including a position, with respect to the transverse direction, for an ink ejector, from the plurality of ink ejectors, operating in an undesirable manner;

determining, using the ejector data, that the position for the ink ejector and the position for the page are in alignment in the process direction; and, shifting the logical page to position the page on the continuous sheet such that the ink ejector and the positions for the respective pixels on the page are out of alignment in the process direction.

16. The system of claim 15 wherein:

the print engine includes a second memory element for storing the ejector data in the second memory element; and, the print engine is for transferring the ejector data from the second memory element to the first memory element.

17. The system of claim 15 wherein the print engine includes the at least one specially programmed computer.

18. The system of claim 15 wherein:

the logical page in a first position with respect to the traverse direction; and, the logical sheet includes a second position for the page with respect to the traverse direction, different than the first position.

* * * * *